United States Patent [19]

Fukuzawa et al.

[11] Patent Number: 4,771,615

[45] Date of Patent: Sep. 20, 1988

[54] DEHYDRATING VESSEL OF WASHING MACHINE

[75] Inventors: Sooichi Fukuzawa, Hitachi; Tamotu Shikamori; Yoichi Yoshinaga, both of Ibaraki, all of Japan

[73] Assignee: Hitachi, Ltd., Tokyo, Japan

[21] Appl. No.: 140,629

[22] Filed: Jan. 4, 1988

Related U.S. Application Data

[62] Division of Ser. No. 828,726, Feb. 12, 1986.

[30] Foreign Application Priority Data

Feb. 14, 1985 [JP] Japan ..... 60-25188
May 14, 1985 [JP] Japan ..... 60-100592

[51] Int. Cl.[4] ..... D06F 23/04

[52] U.S. Cl. ..... 68/23 R; 68/148; 210/380.2; 220/468

[58] Field of Search ..... 68/23 R, 23.7, 24, 148, 68/174, 198; 210/380.1, 380.2; 220/468, 370, 372

[56] References Cited

U.S. PATENT DOCUMENTS 1,688,555 10/1928 Rankin ..... 68/23 R
3,146,196 8/1964 Bochan et al. ..... 68/23 R X
4,016,997 4/1977 Roffler ..... 220/468
4,202,187 5/1980 Hukuzawa et al. ..... 68/23 R X
4,637,233 1/1987 Tanaka et al. ..... 68/198

FOREIGN PATENT DOCUMENTS 677276 12/1929 France ..... 68/148
1300085 6/1962 France ..... 68/148
113973 9/1979 Japan ..... 68/23 R

*Primary Examiner*—Philip R. Coe
*Attorney, Agent, or Firm*—Antonelli, Terry & Wands

[57] ABSTRACT

A dehydrating vessel of a washing machine includes a wall formed of non-water absorbing material, and a water absorbing porous material layer attached to an inner periphery of the wall. The water absorbing porous material layer exhibits a capillary action. A plurality of water releasing apertures are formed at the wall and the water absorbing porous material layer. The rate of dehydration achieved in a zone of the dehydrating vessel near the wall of the vessel can be improved, so that the rate of dehydration can be rendered substantially uniform from the wall to the central portion of the vessel without nonuniformity.

12 Claims, 7 Drawing Sheets

DEHYDRATING VESSEL OF WASHING MACHINE

This application is a divisional application of application Ser. No. 828,726, filed Feb. 12, 1986.

BACKGROUND OF THE INVENTION (1) Field of the Invention

This invention relates to a dehydrating vessel of a washing machine which also serves as a washing vessel and to a dehydrating vessel of a washing machine which solely serves as a dehydrating vessel.

(2) Description of the Prior Art

In one type of centrifugal dehydrating vessel of a washing machine of the prior art, the dehydrating vessel is formed at its inner wall surface with elevated portions and depressed portions which extend vertically, as disclosed in Japanese Examined Patent Publication No. 37994/84, for example. In other type of dehydrating vessel, its wall may be formed with water releasing apertures.

One of the problems encountered in this type of dehydrating vessel of the prior art is that its water removing performance is poor. Experiments were conducted on cloths from which water was removed by these types of dehydrating vessels of the prior art to measure the rate of dehydration. The results obtained reveal that, as shown in FIG. 5, the rate of dehydration achieved is as represented by a curve in a solid line.

More specifically, the results of the experiments show that water is not removed satisfactorily from a zone in the dehydrating vessel which is near the inner wall surface and that the removal of water takes place smoothly from a zone which is near the center of the dehydrating vessel where the centrifugal force is small. In the experiments, the speed of rotation of the dehydrating vessel was varied to test the performance of the dehydrating vessel. It has been ascertained that, even if the speed of rotation is varied, it is impossible to obtain a uniform rate of dehydration for the entire zone of the dehydrating vessel from its inner wall surface to is center, although the rate of dehydration can be increased or decreased as a whole.

SUMMARY OF THE INVENTION (1) Object of the Invention

This invention has been developed for the purpose of obviating the aforesaid problem of the prior art. Accordingly, an object of the invention is to provide a dehydrating vessel of a washing machine capable of maintaining its water removing performance at a high level and capable of dehydrating without nonuniformity.

(2) Statement of the Invention

The outstanding characteristics of the invention enabling the aforesaid object to be accomplished is that the wall of the dehydrating vessel is provided at its inner surface with a layer of water absorbing porous material which exhibits a capillary action, to obtain a uniform rate of dehydration for the entire zone of the dehydrating vessel by increasing the rate of dehydration near the inner surface of the wall, whereby the dehydration performance can be maintained at a high level.

DETAILED DESCRIPTION OF THE PREFERRED EMBODIMENTS

Figure 1:
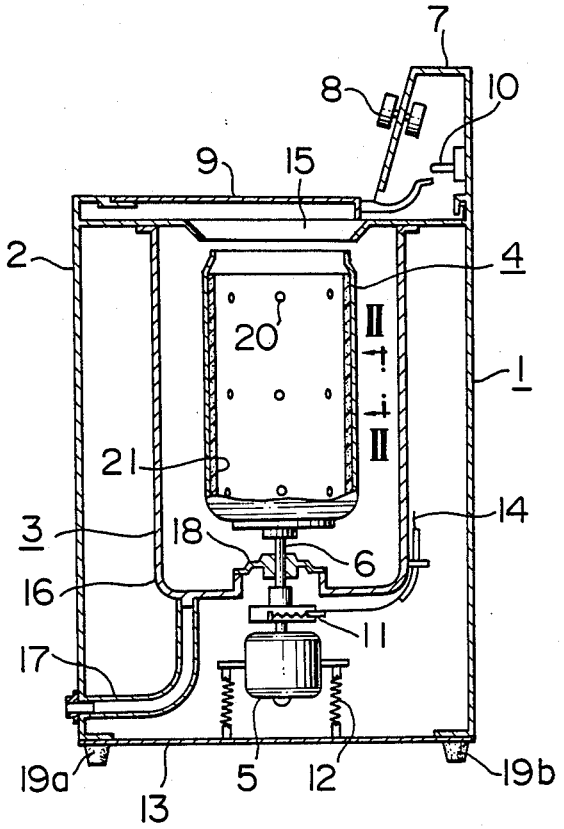
FIG. 1 is a sectional view of a washing machine provided with a dehydrating vessel of one embodiment of the invention.
Figure 2:
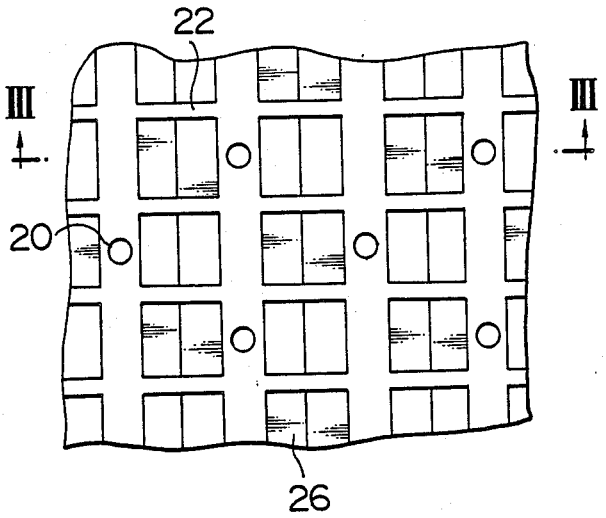
FIG. 2 is a view, on an enlarged scale, of a portion of the dehydrating vessel shown in FIG. 1, as viewed in the direction of arrows II—II in FIG. 1.
Figure 3:
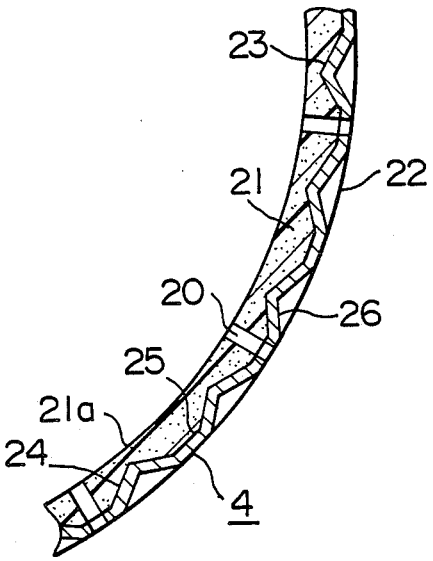
FIG. 3 is a sectional view taken along the line III—III in FIG. 2.

FIGS. 1–3 show one embodiment of the dehydrating vessel in conformity with the invention. The dehydrating vessel shown in these figures is used with what is generally referred to as a washing machine of the double vessel type, with only the dehydrating vessel being shown while the washing vessel is omitted.

A washing machine 1 of the double vessel type comprises an outer framework 2 constituting a shell of the machine, and a centrifugal dehydrator 3 (a dehydrator for short) is mounted in the outer framework 2 and supports therein a dehydrating vessel 4 which is driven for rotation by a motor 5 through a rotary shaft 6.

The operation of the motor 5 is regulated by a timer 8 on an operation panel 7 located at an upper portion of the washing machine 1, so that the motor 5 rotates for a predetermined period of time.

As a lid 9 covering the top of the dehydrator 3 is opened, the motor 5 is stopped and has the brake applied thereto. A switch 10 and a brake 11 serving this purpose are located behind the operation panel 7 and at an upper portion of the motor 5.

The motor 5 is resilliently supported by a bottom plate 13 of the washing machine 1 through springs 12, and the brake 11 and lid 9 are interconnected by a wire 14 for actuating the brake 11 as the lid 9 is opened (the connection between the wire 14 and lid 9 is not shown).

An inlet port 15 is formed at the top of the dehydrator 3 in a position above the dehydrating vessel 4 and below the lid 9 for introducing cloths therethrough into the dehydrating vessel 4. The dehydrator 3 comprises a water receiving vessel 16 enclosing the dehydrating vessel 4 and having a drain 17 and a diaphragm 18 connected to its bottom. Reference numerals 19*a* and 19*b* designate legs of the washing machine 1.

The dehydrating vessel 4 has, attached to the inner periphery of a wall 24 as a lining, a water absorbing porous material layer 21 formed with a multiplicity of pores which provides the wall 24 with an inner wall surface 21*a*. The water absorbing porous material layer 21 may be formed of continuous bubbles of synthetic resinous material.

As shown in detail in FIGS. 2 and 3, the wall 24 of the dehydrating vessel 4 comprises a plurality of inwardly extending elevated portions 23, a plurality of depressed portions 25 each located between the elevated portions 23, a plurality of ribs 22 for reinforcement. The wall 24 is formed with a plurality of water releasing apertures 20 located in the depressed portions 25 and the apertures pass through the porous material layer 21 and the wall 24. Reference numeral 26 designates inclined surface portions of each elevated portion of the wall 24.

When an operation is performed to remove water from clothes by means of the dehydrator 3, at the first a large volume of water is removed from the clothes through the water releasing apertures 20 formed in the wall 24 into the water receiving vessel 16 of the dehydrator 3 from which it is released to outside through the drain 17.

As the water included in clothes is reduced with the progress of the dehydrating operation, a stage is reached at which it would be impossible for a dehydrating vessel of the prior art to remove remaining water from the clothes satisfactorily. However, when the dehydrating vessel 4 according to the invention is used, a flow of water from the clothes to the water absorbing porous material layer 21 is achieved by the capillary action of the water absorbing porous material layer 21 constituting the lining of the wall 24 and the action of the centrifugal forces.

The water that has flowed to the water absorbing porous material layer 21 flows therethrough toward its outer periphery under the influence of centrifugal forces. When it reaches the outer periphery of the water absorbing porous material layer 21, a peripheral component of the centrifugal forces is applied to the water by the inclined surface portions 26 of the elevated portions 23 of the wall 24, so that the water collects in the depressed portion 25 of the wall 24 after flowing through the water absorbing porous material layer 21. The result of this is that the volume of water collecting in the depressed portions increases and the water is continuously released through the water releasing apertures 20, thereby facilitating the flow of the water through the water absorbing porous material layer 21.

By virtue of the aforesaid feature of the invention, the rate of dehydration is increased with regard to the clothes located in contact with the inner wall surface 21*a* of the water absorbing porous material layer 21, and the nonuniformity in dehydration can be eliminated. The invention can achieve the effects of greatly increasing the rate of dehydration when the clothes handled are small in volume.

In the embodiment shown and described hereinabove, the wall of the dehydrating vessel 4 has been shown and described as having elevated and depressed portions at its inner periphery. However, the wall 24 may be a smooth curved surface. It is the action of the water absorbing porous material layer that enables a high dehydrating performance to be achieved.

In the embodiment shown and described hereinabove, the water absorbing porous material layer 21 has been shown and described as being formed of synthetic resinous material provided with a multiplicity of pores exhibiting a capillary action. However, the water absorbing porous material layer 21 may also be formed of ceramic material. Non-woven fabric may also be used to form the water absorbing porous material layer 21.

Figure 5:
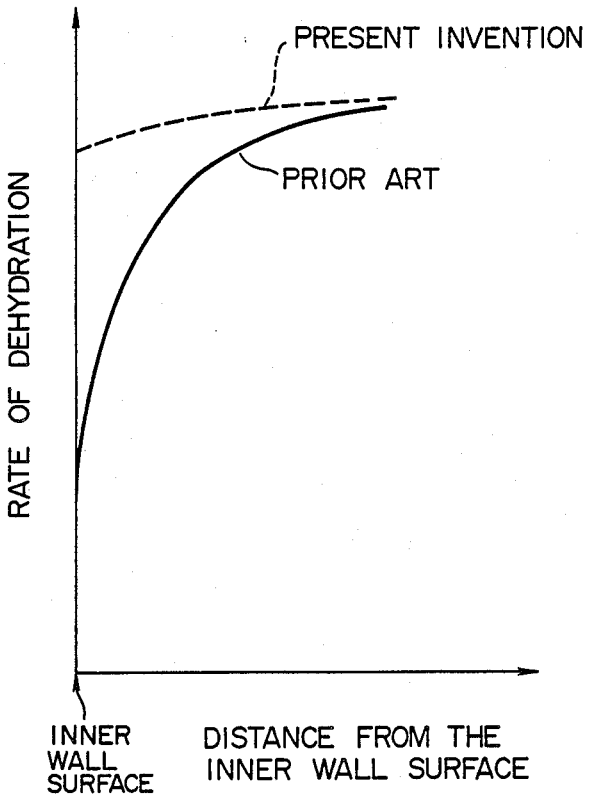
FIG. 5 is a graph showing a comparison of the rate of dehydration achieved by the dehydrating vessel according to the invention with the rate of dehydration achieved by a dehydrating vessel of the prior art.

FIG. 5 shows the result of experiments conducted on the rate of dehydration achieved by the invention in comparison with that achieved by the prior art.

In FIG. 5, a solid line curve representing the rate of dehydration achieved by the prior art shows that the rate of dehydration is low in a zone of the dehydrating vessel near the inner wall surface but rises successively in going from the inner wall surface toward the central portion of the vessel. It is believed that this phenomenon can be explained as follows.

As the water content of the clothes as a whole is reduced with the progress of the dehydrating operation, the water content of the clothes kept in contact with the inner wall surface of the dehydrating vessel is also reduced. A reduction in water content could be considered to appear as a reduction in the size of water drops. Centrifugal forces exerted on the water drops would fall in magnitude as the water drops become smaller in size. Meanwhile, the water drops would be held in position on the fibers by a force of adhesion. As the centrifugal forces become lower in magnitude, a condition would be reached in which the centrifugal forces and the force of adhesion of the water drops match and the water is prevented from being released from the clothes to outside.

On the other hand, a flow of water would be facilitated in the fibers when the clothes are kept in contact with each other, so that the water drops would shift through the fibers of the clothes toward the inner wall surface of the dehydrating vessel even if the centrifugal forces are relatively low in magnitude. As a result, the clothes located in a zone of the dehydrating vessel near the central portion and remote from the inner wall surface would achieve a high rate of dehydration. It is believed that the capillary action of the fibers of the clothes is responsible for this phenomenon.

In the present invention, the wall 24 of the dehydrating vessel 4 is provided with the water absorbing porous material layer 21 which exhibits a capillary action based on the discovery that the capillary action of the fibers facilitates the shifting of water through the fibers. It will be seen that, as indicated by a broken line curve in FIG. 5, the clothes located near the inner wall surface of the dehydrating vessel show a markedly improved rate of dehydration and that the rate of dehydration of the clothes as a whole is greatly improved without nonuniformity.

Figure 4:
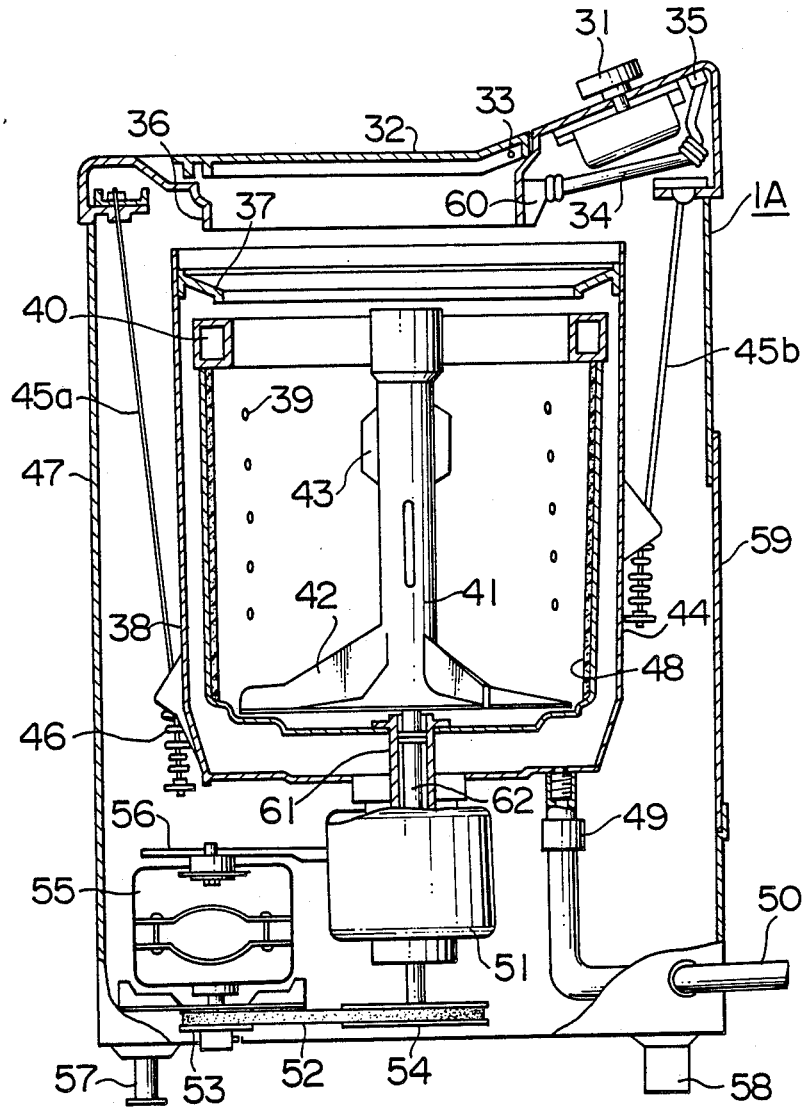
FIG. 4 is a sectional view of a washing machine provided with a dehydrating vessel of another embodiment of the invention.

FIG. 4 shows another embodiment of the invention. The dehydrating vessel shown in this figure is that of a full automatic washing machine of one vessel type which serves also as a washing vessel.

The washing machine 1A comprises a knob 31 for controlling the operation of the washing machine, a lid 32 pivotally supported as indicated at 33 to move between an open position and a closed position, a connecting tube 34 for supplying clear water from a water pipe, not shown, via a water supply valve 35 and through a water inlet port 60, a clothes inlet port 36, a lid 37 for preventing clothes from dropping into an outer vessel 44, and a dehydrating vessel 38. The dehydrating vessel 38 which also serves as the washing vessel includes a wall having a water absorbing porous material layer 48 attached to its inner periphery as a lining which is similar to the water absorbing porous material layer 21 described by referring to FIGS. 1–3. The cross-sectional shape of the water absorbing porous material layer 48 is similar to that of the water absorbing porous material layer 21 shown in FIGS. 2 and 3 and described in detail.

The dehydrating vessel 38 of this embodiment is greater in diameter than the dehydrating vessel 4 of the embodiment shown in FIGS. 1–3 and has a balancer 40 designed to reduce vibration which would occur when a dehydrating operation is performed. A plurality of water releasing apertures 39 are formed in the wall of the dehydrating vessel 38, and a hollow shaft 61 is connected to its bottom.

Extending vertically through the central portion of the dehydrating vessel 38 is an agitating member 41 having small blades 43 and blades 42 at a cylindrical portion and a substantially conical portion, respectively. The agitating member 41 is rotated in normal and reverse directions by a rotary shaft 62 of a clutch 51 with the direction of its rotation being switched at short intervals of time, when the dehydrating vessel 38 serves as a washing vessel.

The outer vessel 44 is supported by suspension rods 45*a* and 45*b* through springs 46 and has, connected to its bottom, a drain 50 communicating the outer vessel 44 to outside and mounting a valve 49 opened and closed by an electromagnet, not shown. A motor 55 supported by a stay 56 is connected by a V-belt 52 trained over pulleys 53 and 54 to the clutch 51 to transmit motive force thereto. The washing machine 1A includes an outer case 47 having a rear lid 59 and legs 57 and 58.

When a centrifugal dehydrating operation is performed by rotating the dehydrating vessel 38 of the aforesaid construction according to the invention, dehydration of clothes can be effected in the same process as described by referring to the embodiment shown in FIGS. 1–3. The dehydrating vessel 38 is capable of achieving a high dehydrating performance without non-uniformity.

In the embodiment shown in FIG. 4, the inner wall surface of the dehydrating vessel 38 with which the clothes to be laundered are brought into contact is preferably a smooth curved surface because the dehydrating vessel 38 also serves as a washing vessel.

In the embodiment shown in FIG. 4 and described hereinabove, the wall of the dehydrating vessel for effecting centrifugal dehydration comprises a plurality of elevated portions which extend inwardly and a plurality of depressed portions each interposed between the elevated portions and is formed with a plurality of water releasing aperture formed in the depressed portions. The wall has, attached to its inner periphery as a lining, a water absorbing porous material layer exhibiting a capillary action. The dehydrating vessel of the aforesaid construction has a high-dehydrating performance and is free from the nonuniformity of dehydration.

As described hereinabove, FIG. 5 shows a graph in which the invention is compared with the prior art with regard to a rate of dehydration. It will be seen that the dehydrating vessel according to the invention can achieve a high rate of dehydration in a zone of the dehydration vessel which is near the inner wall surface of the vessel and the rate of dehydration is substantially uniform for the entire zone of the vessel.

In the embodiment of the invention, water is released mainly through the water releasing apertures formed in the wall and the water released through the water absorbing porous material layer exhibiting a capillary action is small in volume, when the clothes have a high water content. Thus, at the inner wall surface of the dehydrating vessel, the water released from the clothes flows toward the water releasing apertures. Minuscule particles of dirt tending to adhere to the water absorbing porous material layer are washed away by the water flowing into the water releasing apertures, thereby preventing obturation of the water absorbing porous material layer from taking place and allowing the layer to perform the capillary action satisfactorily with excellent effects.

Figure 6:
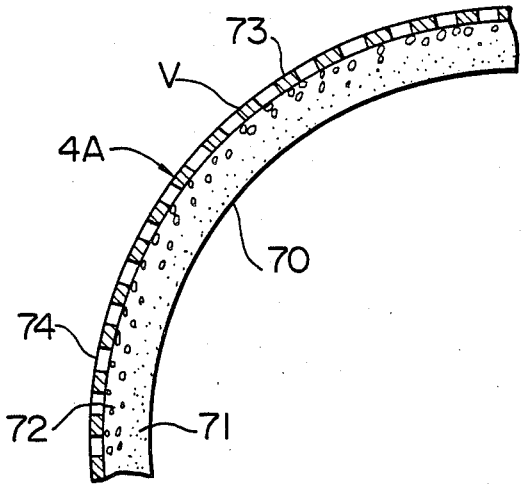
FIG. 6 is a sectional view of a dehydrating vessel of another embodiment of the invention.

FIG. 6 shows a dehydrating vessel 4A according to still another embodiment of the invention which comprises a water absorbing porous material layer 70 including two layer portions, namely, an inner layer portion 71 and an outer layer portion 72. The inner layer portion 71 is higher in density and compactness than the outer layer portion 72, and the outer layer portion 72 is lower in density and higher in the percentage of voids than the inner layer portion 71. The inner layer portion 71 has pores smaller in mean diameter than those of the outer layer portion 71.

A wall 73 of an outer vessel V serving as a structural member for providing strength to the water absorbing porous material layer 70 which is necessary to the dehydrating vessel 4A is located at the back of the water absorbing porous material layer 70, and a multiplicity of water releasing apertures 74 are formed in the wall 73.

When an operation is performed to remove water from clothes by using the dehydrating vessel 4A of the aforesaid construction, a flow of water from the clothes to the water absorbing porous material layer 70 takes place smoothly by virtue of the capillary action of the water absorbing porous material layer 70 which is backed up by the wall 73 and the centrifugal forces, even if a stage is reached at which it would be impossible for dehydrating vessels of the prior art to effect removal of water satisfactorily from the clothes by the centrifugal forces.

The material forming the outer layer portion 72 is higher in the percentage of voids than the material forming the inner layer portion, as described hereinabove. Because of this, the volume of vacant spaces becomes large in comparision with the area of the wet surfaces in the porous material layer, and the water in the outer layer portion 72 becomes more susceptible to the influences exerted by centrifugal forces produced by the rotation of the dehydrating vessel 4A than to those exerted by surface tension tending to cause a capillary phenomenon to occur, with the result that the water is readily removed from the water-absorbing porous material layer 70.

Thus, the flow of water through the water absorbing porous material layer 70 continuously takes place, and the water can be readily released therefrom with a high degree of efficiency. The clothes kept in contact with the inner surface layer 71 has an improved rate of dehydration and the rate of dehydration becomes substantially uniform for the entire zone of the dehydrating vessel 4A. Particularly when clothes of small volume are subjected to dehydration, it is possible to greatly improve the rate of dehydration.

The material forming the inner layer portion 71 of the water absorbing porous material layer 70 is greater in density and has pores of smaller mean diameter than the material forming the outer layer portion 72, as described hereinabove. Thus, the inner layer portion 71 has sufficiently high wear resistance and strength to withstand the load applied thereto even if clothes are brought into direct contact therewith. Therefore, the dehydrating vessel 4A has a long service life.

Figure 7:
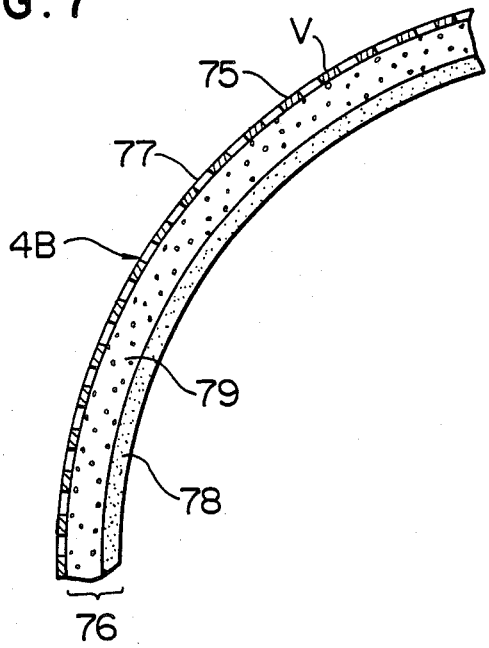
FIG. 7 is a sectional view of a dehydrating vessel of another embodiment of the invention.

FIG. 7 shows a dehydrating vessel 4B according to a further embodiment of the invention, in which a water absorbing porous material layer 76 located inwardly of wall 75 of an outer vessel V having ordinary strength comprises two layers, namely, an inner layer 78 and an outer layer 79. The wall 75 is formed with a multiplicity of water releasing apertures 77.

As shown in the figure, the inner layer 78 is higher in density and compactness than the outer layer 79, and the outer layer 79 is higher in the percentage of voids than the inner layer 78. The inner layer 78 is smaller in the mean diameter of pores than the outer layer 79.

The embodiment shown in FIG. 7 which achieves substantially the same effects as the embodiment shown in FIG. 6 offers the additional advantage that the dehydrating vessel 4B can be readily fabricated.

Figure 8:
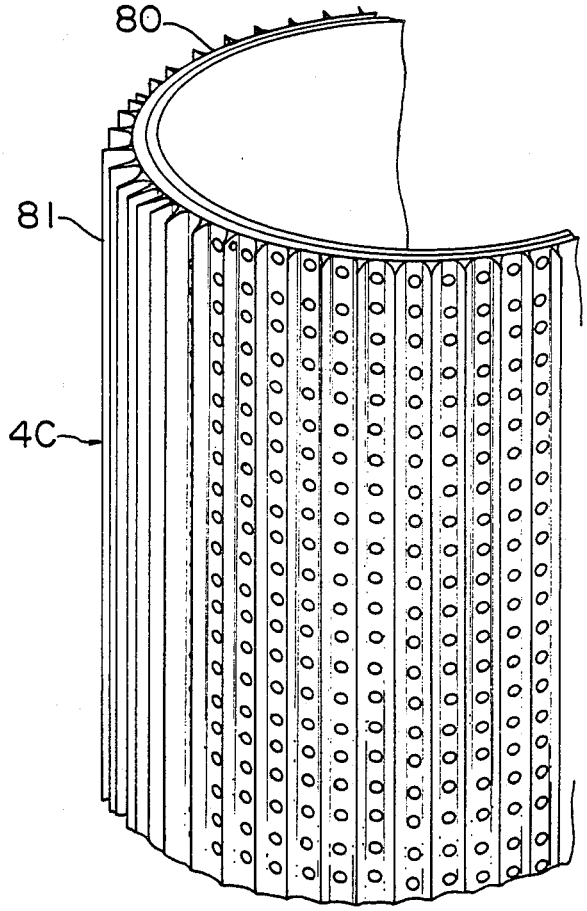
FIG. 8 is a fragmentary perspective view of a modification of the embodiments shown in FIGS. 6 and 7, showing the outer wall surface of the dehydrating vessel formed with a multiplicity of fins.
Figure 9:
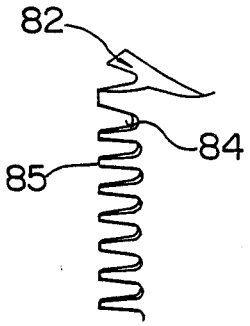
FIG. 9 is a view of a fin distinct from that of the fins shown in FIG. 8.
Figure 10:
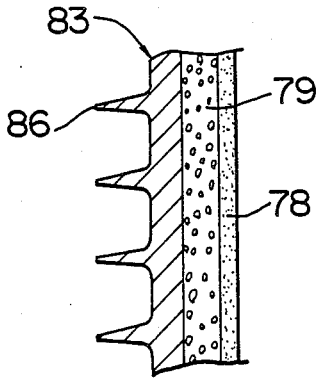
FIG. 10 is a sectional view of the fins shown in FIG. 9.

FIGS. 8–10 show modifications of the dehydrating vessels shown in FIGS. 6 and 7, in which fins are attached to the outer surface of the wall of the dehydrating vessel, to facilitate removal of water under the influence of centrifugal forces.

A dehydrating vessel 4C shown in FIG. 8 comprises a wall 80 and a water absorbing porous material layer similar to those shown in FIGS. 6 and 7. The wall 80 is formed at its outer surface with a multiplicity of fins 81 extending parallel to the axis of rotation of the dehydrating vessel 4C.

The presence of the axial fins 81 renders drops of water more susceptible to the influences exerted by centrifugal force than to the influences exerted by surface tension. Thus, the drops of water can be readily removed from the dehydrating vessel 4C.

In FIGS. 9 and 10, there are shown fins of constructional forms distinct from that shown in FIG. 8. In FIG. 9, reference number 82 designates a wall of the dehydrating vessel, and fins extending parallel to the axis of rotation of the dehydrating vessel on the outer surface of the wall 82 are formed with a plurality of outwardly extending needles 85 equidistantly spaced apart from each other formed by grooves 84. The use of the needle like fins 85 of this constructional form is conductive to improved rate of dehydration. In FIG. 10, reference number 83 designates a wall of the dehydrating vessel, and the wall 83 is formed at its outer surface with a plurality of circumferential fins 86.

From the foregoing description, it will be appreciated that the dehydrating vessel provided by the present invention is high in water removing performance and capable of dehydrating without nonuniformity.

What is claimed is:

1. A dehydrating vessel of a washing machine comprising:

a wall made of a material that does not absorb water;

a porous material layer attached to an inner periphery of said wall, said porous material layer including an inner layer portion and an outer layer portion, said outer layer portion being closer to said wall, said inner layer portion having pores smaller in mean diameter thereof than those of said outer layer portion; and a plurality of apertures passing through at least said wall.

2. A dehydrating vessel of a washing machine as claimed in claim 1, wherein said wall comprises a plurality of inwardly extending elevated portions and a plurality of depressed portions each located between said elevated portions, and said plurality of apertures are provided at said depressed portions.

3. A dehydrating vessel of a washing machine as claimed in claim 1, wherein said inner layer portion is higher in density and compactness than the outer layer portion.

4. A dehydrating vessel of a washing machine as claimed in claim 3, wherein said outer layer portion has a higher percentage of voids than the inner layer portion.

5. A dehydrating vessel of a washing machine as claimed in claim 1, wherein the inner and outer layer portions are respectively individual layers.

6. A dehydrating vessel of a washing machine as claimed in claim 1, wherein said wall is formed with a plurality of fins at an outer surface thereof.

7. A dehydrating vessel of a washing machine as claimed in claim 6, wherein said dehydrating vessel is adapted to rotate around an axis thereof, and wherein said fins extend parallel to the axis of rotation of said dehydrating vessel.

8. A dehydrating vessel of a washing machine as claimed in claim 6, wherein said fins are formed with a plurality of outwardly extending needles.

9. A dehydrating vessel of a washing machine as claimed in claim 6, wherein the wall is substantially circular in cross-section, and wherein the fins extend circumferentially over the outer surface of said wall.

10. A dehydrating vessel of a washing machine as claimed in claim 1, wherein the wall is substantially circular in cross-section.

11. A dehydrating vessel of a washing machine as claimed in claim 1, wherein the porous material layer exhibits capillary action for water.

12. A dehydrating vessel of a washing machine as claimed in claim 1, wherein said outer layer portion has a higher percentage of voids than the inner layer portion.

* * * * *